United States Patent [19]

Muri

[11] Patent Number: 4,562,887

[45] Date of Patent: Jan. 7, 1986

[54] WATER-COOLED CONDENSER TUBE-PLATE ATTACHMENT

[75] Inventor: Werner Muri, Baden, Switzerland

[73] Assignee: BBC Brown, Boveri & Company, Limited, Baden, Switzerland

[21] Appl. No.: 601,679

[22] Filed: Apr. 18, 1984

[30] Foreign Application Priority Data

Apr. 28, 1983 [CH] Switzerland ..... 2278/83

[51] Int. Cl.[4] ..... F28F 9/02

[52] U.S. Cl. ..... 165/158; 29/157.4; 228/107; 228/175; 228/183

[58] Field of Search ..... 165/158; 29/157.4; 228/107, 108, 109, 175, 183

[56] References Cited

U.S. PATENT DOCUMENTS

| | | | |
|---|---|---|---|
| 3,182,720 | 5/1965 | Brown | 165/158 |
| 3,430,323 | 3/1969 | Brown et al. | 228/107 X |
| 3,630,694 | 12/1971 | Enright | 228/107 X |
| 3,861,460 | 1/1975 | Lenhardt | 165/158 |
| 4,010,965 | 3/1977 | Izuma et al. | 228/107 X |
| 4,142,581 | 3/1979 | Yoshitomi et al. | 165/173 |
| 4,221,763 | 9/1980 | Greene | 165/158 |
| 4,252,182 | 2/1981 | Fender | 165/70 |
| 4,287,945 | 9/1981 | Hessari | 165/167 |
| 4,288,109 | 9/1981 | Ellis | 285/158 |
| 4,509,672 | 4/1985 | Woodhull, Jr. et al. | 228/175 |

FOREIGN PATENT DOCUMENTS

| | | | |
|---|---|---|---|
| 0123940 | 11/1984 | European Pat. Off. | 165/158 |
| 2308317 | 11/1972 | Fed. Rep. of Germany | 165/158 |
| 0088445 | 8/1976 | Japan | 228/183 |
| 0010347 | 1/1978 | Japan | 228/107 |

*Primary Examiner*—William R. Cline
*Assistant Examiner*—Randolph A. Smith
*Attorney, Agent, or Firm*—Burns, Doane, Swecker & Mathis

[57] ABSTRACT

A condenser comprising a condenser shell, a plurality of titanium tubes and a titanium tube plate, wherein the condenser shell at the junction with the tube plate is explosion plated with titanium and a water-tight weld is provided between the titanium plating and the tube plate.

4 Claims, 2 Drawing Figures

WATER-COOLED CONDENSER TUBE-PLATE ATTACHMENT

FIELD OF INVENTION

The invention relates to a water-cooled condenser, and more particularly in which the condenser tubes of titanium are rolled and/or welded at each of their ends into a tube plate and in which the tube plates are either fillet-welded or bolted by means of flanges to the condenser shell or the water box shell.

BACKGROUND OF THE INVENTION

Condensers of the above described type, are arranged at the so-called cold end of prime movers and have the purpose of providing a greater pressure gradient and heat gradient by generating the highest possible vacuum in, for example, a steam turbine.

In condensers in which the water box is joined via flanges to the tube plate and the condenser shell, the following problems arise:

machining of the extremely large flanges for the modern large condensers on site turns out to be very expensive;

there is a danger in principle of air being able to penetrate into the steam space of the condenser through the large flanges;

leaking flanges can be sealed at a later date only by very rough and ready methods and with great difficulty.

In a completely welded structure, the steel sheet walls of the water boxes are welded to the condenser shell and the tube plates of steel sheet are as a rule welded into the water boxes. This gives rise to the following problems:

the tube plate must be provided with a rust-resisting plating on the water side;

the required protective lining of the water box is drawn over a part of the plated tube plate and becomes very susceptible to damage, in particular in the zone of the tube plate/shell joint;

if the tubes are welded in, there is a risk, due to the axial tube forces during operation, of the plating being detached in the perforated zone of the tube plate;

if, however, the tubes are only rolled in, cooling water due to leakages can, through the plating, reach the tube plate, which is not resistant to sea water, and can cause efflorescent rust thereon.

Power station operators nowadays demand extreme leak-tightness against an irruption of cooling water into condensers. The permissible leakage rates are almost unmeasurable, and this has the result that the hitherto used technique of rolling the tubes in is supplemented by welding the tubes in. In addition, extremely corrosion resistant titanium tubes are used nowadays.

In the case of the flanged joint mentioned, it is then possible to roll and/or weld the titanium tubes also into titanium tube plates. This is obvious in particular for the reason that titanium can virtually only be welded to titanium. For bolting the titanium tube plate to the flanges of both the water box shell and the condenser shell, appropriate gaskets must be provided. The rubber layer of the protective lining, which was required in any case, was therefore arranged between the water box shell and the tube plate, whilst a soft gasket was inserted between the tube plate and the flange of the condenser shell. After a prolonged operating period, however, such a solution can lead to an irruption of both cooling water and air into the steam space, since the gaskets are very highly stressed due to the different expansions of the tubes and the condenser shell.

In the welded structure, and if titanium tubes are used, the plating must also consist of titanium for the reasons given. Due to the heat stresses which occur, however, there is a risk—even if only slight—of the plating becoming detached. Since, in particular in modern nuclear plants which make extremely stringent demands on the purity of the feed water, this is completely unthinkable, the power station operators demand absolutely safe solutions. With respect to corrosion and leak-tightness, only titanium tube plates can therefore be considered next to titanium tubes.

OBJECTS AND SUMMARY OF THE INVENTION

The invention is therefore based on the object of providing, in a water-cooled condenser of the type initially mentioned, a joint between the tube plate and the steel sheet of the condenser shell or water box shell.

A further object of the present invention is to make it possible for the first time to use tube plates of titanium in welded structures and, in the case of flanged structures, to provide the critical area with an absolutely tight welded joint.

BRIEF DESCRIPTION OF THE DRAWING

Two preferred embodiments of the present invention are shown in the drawing in which.

In the figures, the same elements are always provided with the same reference numbers. Elements which are not essential to the invention, such as, for example, the design of the water chamber and that of the tube entries, are not shown, even though the corrosive action of the cooling water is a limiting condition with respect to their design. The actual tube fixing and the bundle-shaped configuration of the tubes in the steam space are also not shown, since they do not contribute anything to a better understanding of the invention. It should also be said that the actual geometry of the condenser, its size and its type of arrangement are not relevant in the present connection and that the shape of the tube plates, whether circular or polygonal, also has no influence on the mode of action of the invention. All this has the result that the invention can be explained by reference to a simple elementary sketch of a water box.

DETAILED DESCRIPTION OF THE PREFERRED EMBODIMENTS

Figure 1:
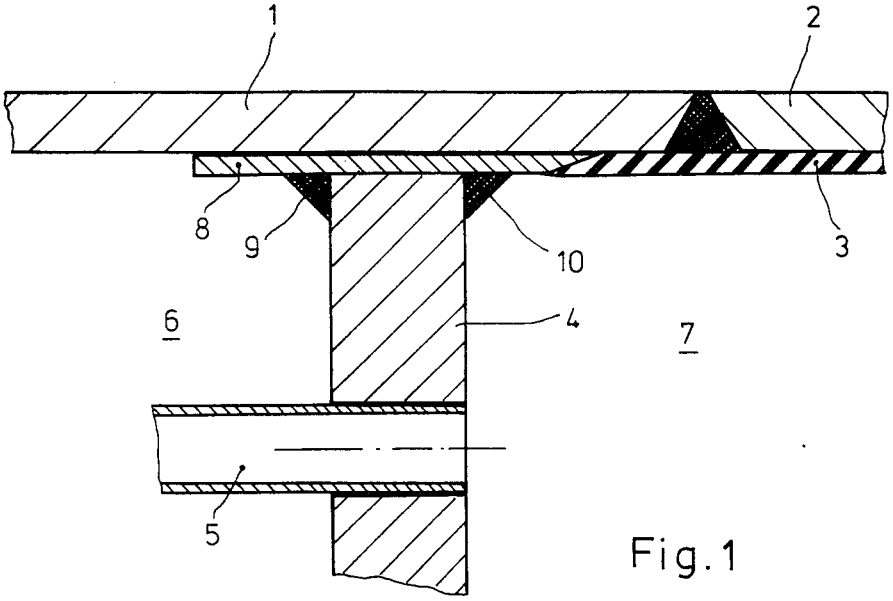
FIG. 1 is a partial longitudinal section of a tube plate welded into the condenser shell in accordance with the present invention.

Referring to FIG. 1, a condenser shell 1 of ordinary carbon steel is welded to the water box wall 2 which likewise consists of ordinary steel sheet. Particularly if sea water is used as the coolant, the wall 2 is completely covered on the water side, and the shell 1 is partially covered, with a protective lining 3 which as a rule is a rubber layer, but can also be a glass fibre-reinforced epoxide resin coating. The tube plate 4 consists of pure titanium. It is fitted with a multiplicity of titanium tubes 5, the ends of which can either be rolled in or welded in, or both. Fresh cooling water from the first water box 7 is delivered into the second, opposite water box through these tubes which form the actual cooling surface and penetrate the entire length of the steam space 6 and are also supported on support sheets which are not shown. In the steam space 6, there is crossflow of the steam, which is to be condensed, around the tubes.

According to the invention, the inside of the condenser shell 1 is now provided with explosion-plated titanium 8 at that point where the joint with the tube plate 4 is made. To ensure strength of the plating, the axial extent of the latter (relative to the tube axes) is greater than would correspond to the tube plate thickness.

Explosion-plating, or explosion-welding, is a process, by means of which metal combinations can be produced which are not possible by fusion-welding. Titanium sheet is laid at a small distance above the condenser shell which is to be coated. The explosive distributed over the titanium sheet is ignited on one side, whereupon the detonation zone runs at high speed across the titanium and accelerates the latter towards the condenser shell. This generates extremely high pressures in the collision zone, which lead to flow of the metal boundary layers and thus to large-area welding.

On the steam side and water side, the entire circumference of the tube plate 4 is welded to the plating 8 and hence to the condenser shell by means of fillet welds 9 and 10 respectively. Compared with the known welded structure, the novel solution is more advantageous, inasmuch as the feared rust efflorescences cannot occur even in the event of leaking pipe joints. The temporary protection, hitherto customary during shutdowns, is also superfluous. Moreover, the rubber-lining becomes substantially simpler than before, since the tube plate/-shell junction does not have to be bridged. The protective lining 3 is drawn only just over the chamfered end of the plating.

Figure 2:
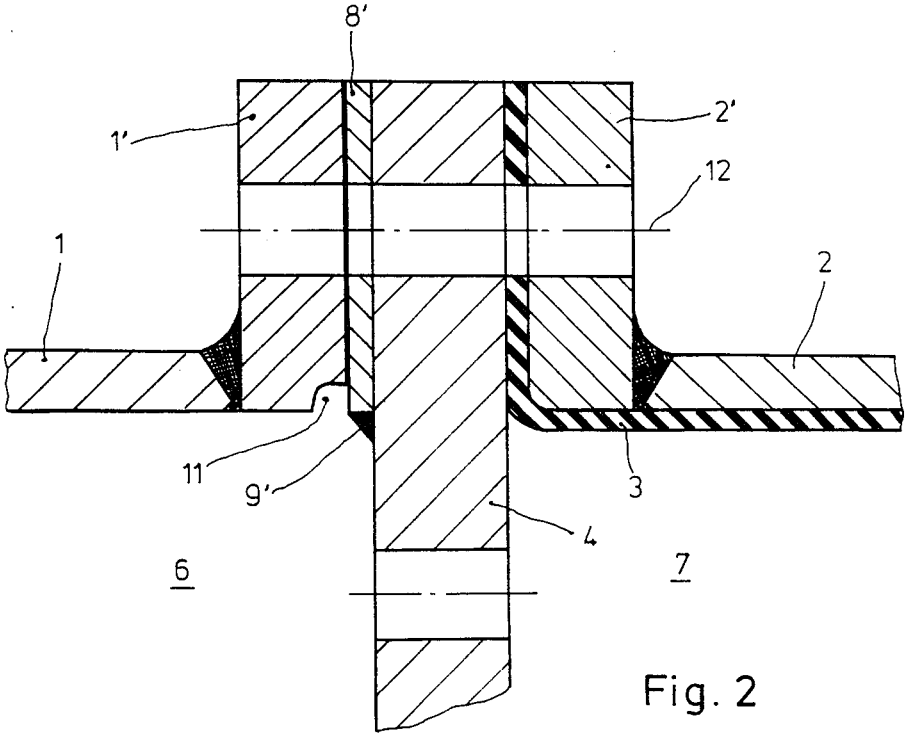
FIG. 2 is a partial longitudinal section of a flanged joint between water box, tube plate and condenser shell constructed in accordance with the present invention.

In the condenser design according to FIG. 2, both the condenser shell 1 and the water box shell 2 are each provided with a welded-on flange 1' and 2' respectively, between which the titanium tube plate is solidly bolted in by means of bolting 12 which is only indicated. On the water side, the protective lining 3 is drawn right into the flange. According to the invention, explosion-plated titanium 8' is provided here on the sealing surface of the flange 1'. After the tube plates have been assembled with the condenser shell, the plating is completely sealed off by a weld seam 9'. To facilitate welding, the flange 1' is provided with a recess 11 in the zone of the welded seal. The steam space is thus safe from both air irruptions and from cooling water which might trickle in via a possibly leaking protective lining 3 and the bolt holes. Fears that the explosion-plating could become detached are immaterial in this design since, due to the bolted joint, the plating is stressed exclusively in compression.

It is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. In a water-cooled condenser having a shell structure and a tube-plate secured to said shell structure, said shell structure comprising a condenser shell and a water box shell, said condenser shell constructed from steel sheet and enclosing a steam space, said tube-plate having a steam space side facing said steam space, said condenser also having a plurality of condenser tubes constructed from titanium, said tubes being secured to said tube-plate, the improvement comprising said tube-plate constructed from titanium, a plating of explosion-plated titanium on said condenser shell coextensive with said tube-plate and a water-tight weld between said titanium plating and said tube-plate on said steam space side.

2. The water-cooled condenser according to claim 1, wherein the tube-plate is secured to the shell structure at a flanged joint between a flange of the condenser shell and a flange of the water box shell, the plating of explosion-plated titanium being on said flange of the condenser shell.

3. The water-cooled condenser according to claim 1, wherein an end of each condenser tube is secured to said tube-plate by a weld.

4. The water-cooled condenser according to claim 1, wherein an end of each condenser tube is rolled into said tube-plate.

* * * * *